United States Patent [19]

Grosboll

[11] Patent Number: 5,069,775

[45] Date of Patent: Dec. 3, 1991

[54] HEAVY CRUDE UPGRADING USING REMOTE NATURAL GAS

[75] Inventor: Martin P. Grosboll, Kingwood, Tex.

[73] Assignee: Atlantic Richfield Company, Los Angeles, Calif.

[21] Appl. No.: 519,638

[22] Filed: May 7, 1990

[51] Int. Cl.[5] ..... C10G 47/00; C10G 47/02

[52] U.S. Cl. ..... 208/108; 208/14; 208/370; 208/107

[58] Field of Search ..... 208/370, 107, 56, 14

[56] References Cited

U.S. PATENT DOCUMENTS

| | | | |
|---|---|---|---|
| 3,369,992 | 2/1968 | Henke et al. | 208/370 |
| 3,532,618 | 10/1970 | Wunderlich et al. | 208/140 |
| 4,172,026 | 10/1979 | Jensen | 208/370 |
| 4,294,686 | 10/1981 | Fisher et al. | 208/56 |
| 4,391,701 | 7/1983 | Le Page et al. | 208/370 |
| 4,483,762 | 11/1984 | Grosboll | 208/216 R |
| 4,514,283 | 4/1985 | Closmann et al. | 208/370 |
| 4,883,582 | 11/1989 | McCants | 208/107 |

*Primary Examiner*—Helane E. Myers

*Attorney, Agent, or Firm*—James C. Fails; Arthur F. Zobal; Geoffrey A. Mantooth

[57] ABSTRACT

A method of producing and upgrading crude oil in flowable form which is characterized by the steps of forming hydrogen from methane gas and hydrogenating only a portion of the crude oils and produce a less viscous bottom stream that is then admixed with the remainder of the crude to form a flowable crude and transporting the flow of crude to a refinery.

8 Claims, 1 Drawing Sheet

HEAVY CRUDE UPGRADING USING REMOTE NATURAL GAS

FIELD OF THE INVENTION

This invention relates to a method of improving the quality of heavy, viscous crude oil. More specifically, it relates to a process involving hydrogenation of only a portion of the crude to create a low viscosity unit, or fraction, that can be combined with the remainder of the crude to form a flowable crude that can be pumped through a pipeline or the like.

DESCRIPTION OF THE PRIOR ART

The prior art is replete with a wide variety of different techniques for upgrading crude oils. These range from hydrogenation to taking different fractions and coking the heavier bottoms, or portion that does not distill over in the distillation column.

It is also well known to convert methane to a liquid product but such conversion of methane to a liquid product is frequently difficult due to the low reactivity and the cost of building whatever process is used in a remote area to convert the methane to a liquid product. For this reason, the value of methane containing streams is not as great at remote sites as it is in highly industrialized areas.

One of the most pertinent references known to the inventors is U.S. Pat. No. 4,294,686 in which an integrated upgrading process is disclosed which can be used to lower the specific gravity viscosity in a range of viscous hydrocarbonaceous crudes by means of fractionally distilling the crude and treating a particular fraction with hydrogen donor material to lower its viscosity and then recombining the lower-viscosity liquid portion of the crude with the remainder to form a recombined, syncrude, or reconstituted crude, suitable for transport by normal crude pipelines. As will be appreciated, this is a relatively complicated process and has various drawbacks. Also pertinent is U.S. Pat. No. 4,483,762 entitled "Hydrocarbon Conversion Process Using Molybdenum Catalyst", same inventor, same assignee. The title is descriptive of the invention.

It is desirable that the invention provide the following features.

It would be desirable if the process could be employed to provide the feature of allowing hydrogenation of only a part of the crude to decrease viscosity and increase value of the crude and decrease capitalization costs.

It is particularly desirable that the invention provide the feature of providing a process that employs less valuable constituents such as methane and still yields a flowable product.

SUMMARY OF THE INVENTION

Accordingly, it is an object of this invention to provide at least one of the features delineated hereinbefore as desirable and not provided by the prior art.

It is a specific object of this invention to provide substantially all of the features delineated hereinbefore as desirable and not provided by the prior art.

These and other objects will become clearer from reference to the following descriptive matter, particularly, when taken in conjunction with the appended drawings.

In accordance with one embodiment of this invention, there is provided a method which is characterized by the following steps: First, hydrogen is generated from a remote methane; that is, methane gas produced from a remote well where it has relatively less value than in industrialized area. This step of producing hydrogen may be done with suitable catalyst as shown in the production of synthesis gas or the like, as well as the reaction further with excess steam to produce hydrogen from the reaction of the steam and the carbon monoxide. Secondly, the hydrogen is mixed with only a portion of the crude which is to be upgraded. Ordinarily such a crude will be so viscous that it cannot flow easily through a pipeline or the like to a refinery and cannot be employed in a refinery in large quantities because the quantity and quality of 1000 degrees F. material would overload downstream units such as delayed coking. This process produces a light oil which has a low viscosity and flows easily. Next, or as a third step, the light oil is admixed with the remainder of the crude to produce a flowable crude oil. The light oil produced when mixed with unprocessed heavy crude will form a material more like typical crude, in terms of boiling range and percent boiling above 1000 degrees F. Finally, the flowable crude oil is transported to refinery or the like. The transporting of oil may involve additional steps such as transport by truck, ship or the like in addition to the use of pipeline transport.

DESCRIPTION OF PREFERRED EMBODIMENTS

The process of this invention is applicable to upgrading various types of heavy crudes that cannot be processed in a refinery in normal form. These include the heavy oils bitumen, tar and tar sands, such as those obtainable from Athabasca and crude oil whose composition and viscosity make it impossible to process in a conventional oil refinery or to transport in a pipeline without dilution or external heating someway.

As indicated, hydrogen is produced from the methane in a remote process. The process for producing hydrogen is well known and is recorded in text books such as the old second addition of the "Textbook of Organic Chemistry"; Wertheim, Tom E., Editor, the Blakiston Company, Philadelphia, Penna., 1947, page 33. Therein is disclosed a method of heating methane with steam to yield carbon monoxide and hydrogen in accordance with reaction formula I.

$$CH_4 + HOH\ (xs) \rightarrow CO + 3H_2 \qquad (I)$$

Additional hydrogen may be produced from the excess carbon monoxide according to reaction formula II.

$$CO + HOH \rightarrow CO_2 + H_2 \qquad (II)$$

In the reaction of formula I, it is frequently helpful to employ, in addition to a temperature of 800–1000 degrees Fahrenheit, a Nickel and Alumina catalyst. In the second step, or the reaction of formula II it is helpful to use an iron oxide-chromium oxide catalyst and about 500 degrees F. to get the reaction to produce hydrogen.

On the other hand, if desired to produce carbon black or solid carbon, a pyrolysis of the methane may be employed to yield the hydrogen plus carbon at about 1000 degrees with inadequate air to burn completely. It is ordinarily preferred to employ the synthesis gas method of producing hydrogen according to reaction formulas I and II.

Figure 1:
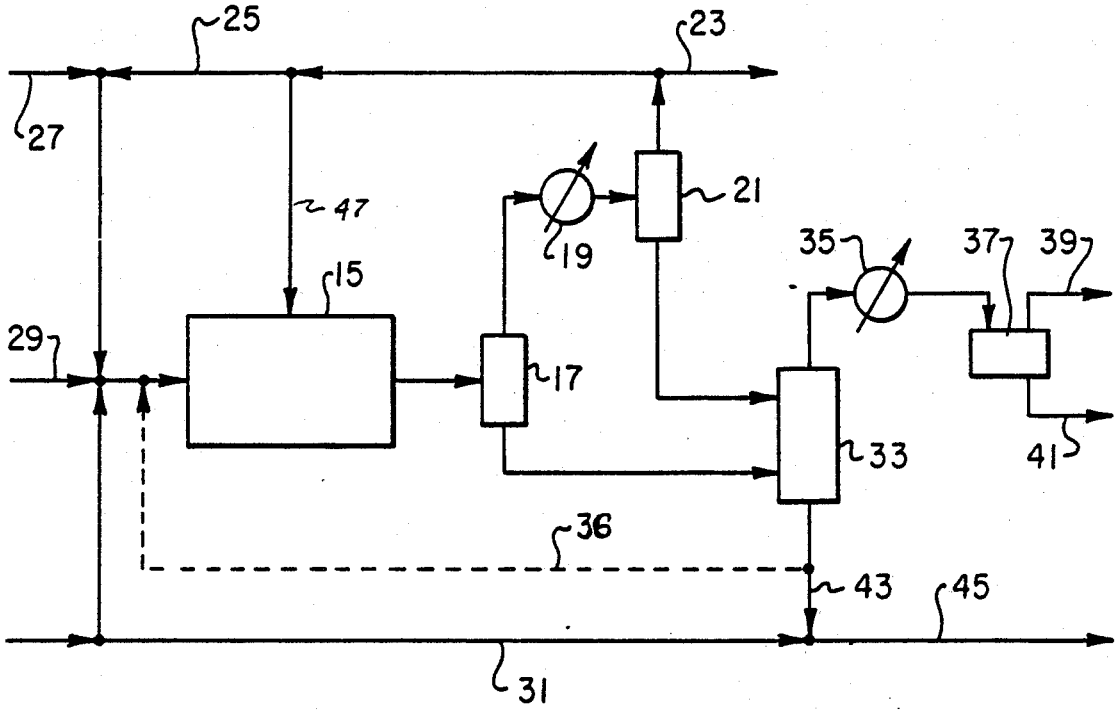
FIG. 1 is a schematic illustration of an embodiment of this invention showing optional steps.

Referring to FIG. 1, the fraction of the heavy crude to be hydrogenated is hydrogenated in reactor 15. If no catalyst is employed, the reactor may be operated, for example, at about 2000 psig and 800 degrees Fahrenheit to hydrogenate the crude flowing therethrough.

It is theorized that the hydrogenation of aromatics occurs with subsequent cracking to smaller molecules. The presence of $H_2$ prevents unsaturated compounds produced from cracking to form to any large extent. The net result is a lower boiling material with a higher hydrogen content.

The reaction of the hydrocarbonaceous crude with the hydrogen in the reactor section 15 may be termed "hydroconversion". The term "hydroconversion" is used herein to designate a catalytic process conducted in the presence of hydrogen in which at least a portion of a hydrocarbon fraction; for example, the heavier or high boiling constituents and coke precursors of the crude is converted to lower boiling hydrocarbon products while simultaneously reducing the concentration of at least one of the contaminants such as nitrogenous, sulfurous or metallic compounds.

As catalyst for this hydroconversion, molybdenum-containing catalyst can be employed. In preparing the molybdenum-containing catalysts useful in this invention, metallic molybdenum is interacted; that is co-mingled or contacted; with at least one peroxy compound; for example, organic hydroperoxide, organic peroxide, organic peracid, hydrogen peroxide and mixtures thereof in the presence of at least one low molecular weight saturated alcohol, either mono- or poly-hydroxy, containing from one to four carbon atoms per molecule to solubilize at least a portion of the molybdenum metal. It is believed that the molybdenum metal reacts with the peroxy compound to form a complex which is soluble in the saturated alcohol and remaining peroxy compounds.

Typical peroxides, hydroperoxides and peracids useful in the preparation of the molybdenum-containing catalyst include, by way of example, hydrocarbon peroxides, hydrocarbon hydroperoxides and hydrocarbon peracids where the hydrocarbon radicals in general contain up to about 20 carbon atoms per active oxygen atom. With respect to the hydrocarbon peroxides and the hydrocarbon hydroperoxides, it is particularly preferred that such hydrogen radical contain from about four to about 18 carbon atoms per active oxygen atom and more particularly from four to 10 carbon atoms per active oxygen atom. With respect to the hydrocarbon peracids, the hydrocarbon radical is defined as that radical which is attached to the carbonyl carbon and it is preferred that such hydrocarbon radical contain from one to about 12 carbon atoms, more preferably from one to about eight carbon atoms, per active oxygen atom. It is intended that the term organic peracid include, by way of definition, performic acid.

Typical examples of the hydrocarbon radicals are alkyls such as methyl, ethyl, butyl, t-butyl, pentyl, n-octyl and those aliphatic radicals which represent the hydrocarbon portion of a middle distillate of kerosene, and the like; cycloalkyl radicals such as mono- and polymethylcyclo-pentyl radicals and the like; aryl radicals such as phenyl, naphthyl and the like; cycloalkyl substituted alkyl radicals such as cyclohexyl methyl and ethyl radicals and the like; alkyl phenyl substituted alkyl radicals examples of which are benzyl, methyl-benzyl, capryl-benzyl, phenylethyl, phenylpropyl, naphthylmethyl, naphthylethyl and the like; alkaryl radicals such as xylyl, methylphenyl and ethylphenyl and the like radicals.

Typical examples of peroxy compounds are hydroxyheptyl peroxide, cyclohexanone peroxide, tertiary butyl peracetate, di-tertiary butyl diperphthalate, tertiary butyl perbenzoate methyl ethyl ketone peroxide, dicumyl peroxide, tertiary butyl hydroperoxide, di-tertiary butyl peroxide, p-methane hydroperoxide, pinane hydroperoxide, 2,5-dimethylhexane-2,5-dihydroperoxide, cumene hydroperoxide and the like; as well as organic peracids such as performic acid, peracetic acid, trichloroperacetic acid, per-benzoic acid, perphthalic acid and the like.

In order to obtain the maximum benefits of the present invention, the most preferred peroxy compound for use in this invention is tertiary butyl hydroperoxide.

These peroxy compounds may be substituted with groups such as halides, $—NH_2$, —SH, and the like which do not actually interfere with the catalyst forming process.

Hydrogen peroxide suitable for preparing the molybdenum-containing catalyst is preferably used in the form of an aqueous solution containing for example, from about 10% to about 60%; preferably, about 30%; by weight of hydrogen peroxide Typical examples of low molecular weight monohydroxy alcohols which are suitable for use in the preparation of the present molybdenum-containing catalyst include methyl alcohol, ethyl alcohol, isopropyl alcohol, n-butyl alcohol, tertiary butyl alcohol and the like. The low molecular weight polyhydroxy alcohols which are suitable include ethylene glycol, propylene glycol, 1,2-butyl glycol and glycerol. In general, either mono- or poly-hydroxy alcohols containing from one to four carbon atoms per molecule are suitable. Although the presence of the lower alcohols; for example, methyl alcohol and ethyl alcohol, produces a faster solubilization of molybdenum, in order to maximize the benefit of the overall process of the present invention it is preferred that the molybdenum metal be interacted with tertiary butyl hydroperoxide in the presence of tertiary butyl alcohol. If tertiary butyl alcohol is used as the saturated alcohol, it is preferred, to enhance molybdenum solubility, that the interaction mixture comprise additionally at least one mono- or poly-hydroxy alcohol having from one to about 16 carbon atoms per molecule, and at least one primary hydroxy group, and be present in an amount of from about 1 to about 25 percent by weight of the total alcohol present. A particularly preferred alcohol mixture for use in combination with tertiary butyl alcohol is a stream of higher polyhydroxy alcohols having a molecular weight in the range from about 200 to about 300 and containing from about 4 to about 6 hydroxy groups derived from propylene epoxidation and described in U.S. Pat. No. 3,573,226.

The relative proportions of peroxy compound and low molecular weight saturated alcohol employed in preparing the catalyst may vary over a broad range and are, therefore, not of critical importance to the invention. Typically, the peroxy compound comprise from about 5 to about 50 percent by weight of the total peroxy compound and saturated low molecular weight alcohol used in catalyst preparation.

The molybdenum concentration in the catalyst mixture, for example, the mixture comprising the dissolved or soluble molybdenum plus any excess peroxy compound and alcohol, often is within the range of about 15 parts per million (ppm.) to about 5 percent, preferably in the range of about 1,000 ppm. to about 2 percent by weight of the total mixture. It may be desirable to prepare the catalyst in the presence of a solvent such as benzene, ethyl acetate and the like, in order to obtain the optimum molybdenum concentration in the final catalyst mixture. However, if this type of dilution is desired, it is preferred that an excess of tertiary butyl alcohol be maintained in the catalyst mixture for this purpose.

The molybdenum metal useful in the preparation of the present catalyst may be in the form of lumps, sheets, foil or powder. The powdered material, e.g., having a particle size such that it passes through a 50 mesh sieve, preferably through a 200 mesh sieve, on the Standard Screen Scale, is preferred since it offers increased surface area per unit volume and an increased rate of solubilization.

The molybdenum metal-peroxy compound interacting may be carried out at a wide range of temperatures, for example, temperatures within the range from about 25 degrees C. to about 150 degrees C. Interacting pressures should be set to avoid extensive vaporization of the peroxy compound and alcohol. Typical interacting pressures may range from about 1 pound per square inch absolute (psia.) to about 100 psia. In many instances, atmospheric pressure may be used. After the interacting has been carried out for a desired length of time, e.g., from about 5 minutes to about 300 hours, preferably from about 15 minutes to about 6 hours, the product from the interacting may be filtered to separate the undissolved molybdenum from the catalyst mixture which is thereafter suitable for use as a catalyst for the oxidation of sulfur impurities in hydrocarbon material.

The process of this invention is applicable to heavy hydrocarbonaceous oils such as heavy mineral oil; whole or topped petroleum crude oils, including heavy crude oils; polynuclear aromatics such as asphaltenes, residual oils such as petroleum atmospheric distillation tower resids (boiling above 650 degrees F.) and petroleum vacuum distillation tower resids (vacuum residues, boiling above about 1,050 degrees F.); tars, bitumen; tar sand oils, shale oils. The process is particularly well suited to heavy crude oils and residual oils which generally contain a high content of metallic contaminants (nickel, iron, vanadium) usually present in the form of organometallic compounds, e.g., metalloporphyrins, a high content of sulfur compounds, a high content of nitrogenous compounds and a high Conradson carbon residue. The metal content of such oils may range up to 2,000 weight ppm. (wppm.) or more and the sulfur content may range up to 8 weight percent or more. The API gravity at 60 degrees F. of such feeds may range from about −5 degrees API to about +35 degrees API and the Conradson carbon residue of the heavy feeds will generally be at least about 5 weight percent, preferably in the range of about 5 to about 50 weight percent, more preferably about 10 to about 50 weight percent, (as to Conradson carbon residue, see ASTM test D-189-65). Preferably, the feedstock is a heavy hydrocarbon oil having at least 10 weight percent of material boiling above 1,050 degrees F. at atmospheric pressure, more preferably having at least about 25 weight percent of material boiling above 1,050 degrees F. at atmospheric pressure.

In the above embodiment, the molybdenum compound, prepared and described above, is combined with the heavy hydrocarbon chargestock so that the resulting mixture preferably includes about 10 to about 2000 wppm., more preferably about 50 to about 300 wppm., still more preferably about 50 to about 200 wppm. of molybdenum, calculated as elemental metal, based on the heavy hydrocarbon oil chargestock.

In an additional embodiment, the process of the invention is applicable to substantially hydrocarbon chargestock boiling, at atmospheric pressure, in the range of about 430 degrees F. to about 1100 degrees F.; preferably about 500 degrees F. to about 1050 degrees F.; more preferably in the range of about 650 degrees F. to 1050 degrees F.

Various methods can be used to convert the molybdenum compound in the chargestock to a catalyst. One method (pre-treatment method) of forming a catalyst from the molybdenum compound of the present invention is to heat the mixture of the metal compound in the hydrocarbon chargestock to a temperature in the range of at least 600 degrees F. The thermal treatment in the presence of hydrogen or in the presence of hydrogen and hydrogen sulfide is believed to convert the molybdenum compound to the corresponding catalyst. The resulting catalyst contained within the chargestock is then introduced into a hydroconversion zone which will be subsequently described.

A preferred method of converting the oil-soluble metal compound of the present invention to a catalyst is to react the solution of the compound in oil with a hydrogen-containing gas at hydroconversion conditions to produce the catalyst in the chargestock in situ in the hydroconversion zone. Preferably, the hydrogen-containing gas comprises about 1 to about 10 mole percent, more preferably about 2 to 7 mole percent hydrogen sulfide. The conversion of the metal compound in the presence of the hydrogen-containing gas or in the presence of the hydrogen and hydrogen sulfide is believed to produce the corresponding molybdenum catalyst.

The hydroconversion zone is preferably maintained at a temperature in the range of about 650 degrees F. to about 1000 Degrees F., more preferably 750 degrees F. to about 900 degrees F., and still more preferably about 800 degrees F. to about 875 degrees F., and at a hydrogen partial pressure in the range of about 500 to about 5,000 psig., more preferably about 1,000 to about 3,000 psig. Contact of the chargestock catalyst at hydroconversion conditions in the reaction zone with the hydrogen-containing gas converts the metal compound to the corresponding metal catalyst in situ. The hydroconverted oil, possibly containing solids, is removed from the hydroconversion contacting zone. The solids may be separated from the hydroconverted oil by conventional means, for example, by settling, centrifuging or filtration of the slurry or concentration techniques, such as solvent extraction vacuum distillation and the like. At least a portion of the separated solids or solids concentrate may be recycled directly to the hydroconversion contacting zone or recycled to be combined with the hydrocarbonaceous oil chargestock, or may be disposed of.

The space velocity, defined as volumes of chargestock per hour per volume of reactor (V/hr./V), may vary widely depending on the desired hydroconversion level. Suitable space velocities may range broadly from about 0.1 to 10 volumes of oil feed per hour per volume of reactor, preferably from about 0.25 to 6 V/hr./V, more preferably from about 0.5 to 2 V/hr./V. The process of the invention may be conducted either as batch or as continuous type operation.

In the preferred hydrocracking embodiment, the hydrocracking zone is preferably maintained at a temperature in the range of about 700 degrees F. to about 1000 degrees F., more preferably about 800 degrees F. to about 900 degrees F., and at a total pressure in the range of about 100 to 5000 psig., more preferably from about 500 to 3000 psig. Hydrogen is introduced into the reaction zone at a rate of about 300 to about 10,000 standard cubic feet per barrel, preferably at a rate of about 1000 to 5000 standard cubic feet per barrel of hydrocarbonaceous oil. Reaction time may vary widely. Suitable reaction times include from about 5 minutes to about 4 hours, preferably from about 10 minutes to 2 hours depending upon the desired degree of conversion.

In any event, the invention works and the viscosity of the fraction of the crude that is hydrogenated is reduced such that when recombined with untreated crude, the resultant final crude admixture is flowable.

It has been found to be more economical to add hydrogen at about 1000 standard cubic feet per barrel of hydrogen to only one half of the crude than it is to try to add hydrogen at about 500 standard cubic feet per barrel for the entire quantity of crude to produce a lower viscosity crude and then admix with the remainder of the crude. This enables employing reduced capital expenditures at remote locations.

In any event, after the hydrogenation is complete, the lower viscosity reactant is sent to a separator 17 and the overhead goes to a heat exchanger 19 where heat is taken away. If desired the heat can be used in the reactor section to help bring the reactants up to the desired temperature. The amount of heat required is reduced because the hydrogenation reaction is exothermic. The lighter reaction product which has gone overhead also passes through the heat exchanger 19 and on to a separator 21 where the overhead gasses will be rich in hydrogen. A purge stream 23 is employed to control hydrogen purity in the reactor section. The remainder of the stream; particularly, the hydrogen-rich portion, is recirculated back to the reactor section; for example, through line 25. Makeup hydrogen is added to the reactor the reactor through line 47, FIG. 2, to control reactor temperature. If desired and if employed a catalyst may be added through line 29.

Heavy crude bypasses the upgrading section through line 31. For example, about half the crude may be hydrogenated and about half bypassed.

As illustrated, the bottoms from the separator 17 will go to another separator 33. The overhead goes through a heat exchanger 35 and then to a separator 37. An overhead stream 39 will remove gas. Line 39 contains light gases formed by hydroconversion in reactor section 15, primarily methane to butane with some hydrogen. A light liquid line 41 may be employed to take away light liquids that are in the overhead from the separator 33. As will be recognized, line 41 is the bottoms from separator 37 and contains light liquids formed by hydroconversion in reactor section 15, primarily pentane and heavier hydrocarbons, but lighter than those in line 43. Stripping steam may be added through a line (not shown) to control the initial boiling point of the converted crude before it exits line 43. The bottom from the separator 33 may have an optional line shown by dashed line 36, FIG. 1 carrying a portion of the stream back to the reactor 15, or actually, up stream of the reactor 15. Since this stream largely contains unconverted feed, recycling this material can be used to increase conversion. The bottoms from the separator 33 will pass via line 43 to the heavy crude bypassing the upgrading section by way of line 31 to give an upgraded crude in line 45. Thus actually, the bottoms 43 contains the less viscous crude which when combined with the heavy crude in line 31 provides an upgraded mixture, or upgraded crude that is a mixture of less viscous crude and of the heavy crude to yield a flowable crude that can be transported to a refinery or the like. The transportation ordinarily will involve at least at some stage flowing through a pipeline so that it is important that the crude be flowable. Other forms of transportation such as truck, railway or the like may be employed in addition to the hydraulic transport.

Figure 2:
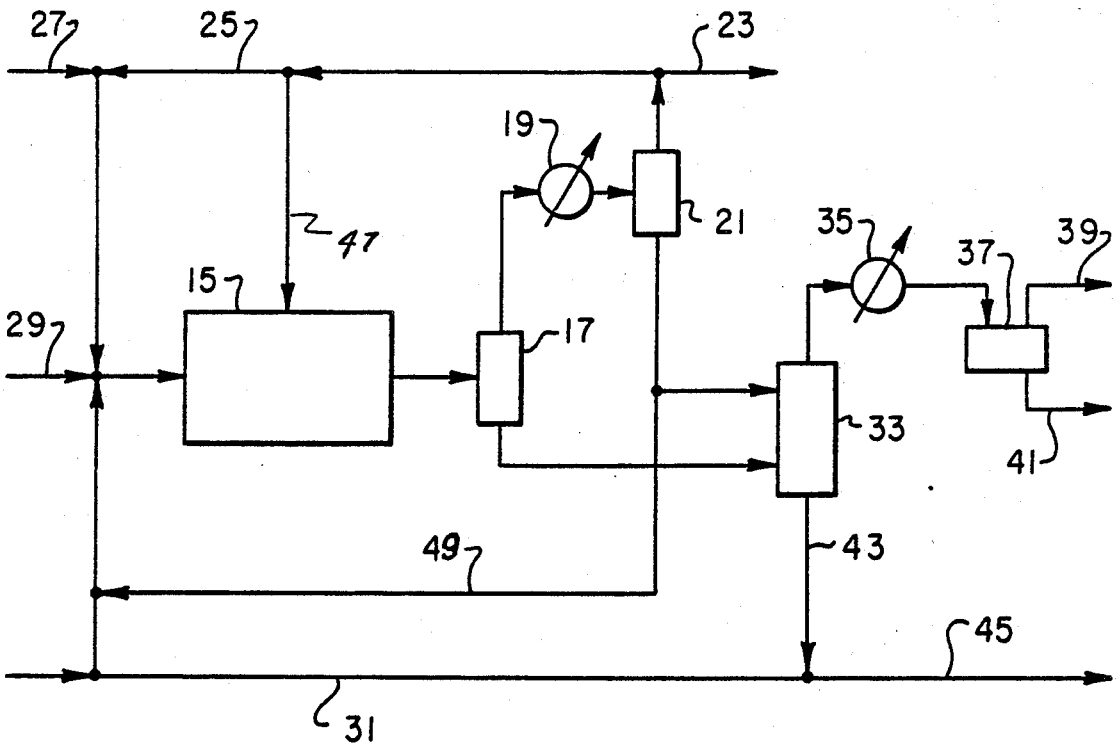
FIG. 2 is another embodiment of this invention illustrating employing of a hydrogen donor fraction.

Referring to FIG. 2, the same relative elements are given the same numbers. The main difference is that the material in line 49 can act as a hydrogen donor to improve the conversion in the reactor section 15.

Although this invention has been described with a certain degree of particularity, it is understood that the present disclosure is made only by way of example and that numerous changes in the details of construction and the combination and arrangement of parts may be resorted to without departing form the spirit and the scope of the invention, reference being had for the latter purpose to the appended claims.

What is claimed is:

1. A method of forming an upgraded crude with a plurality of steps which consist essentially of a. forming hydrogen from methane gas for hydroconverting heavy crude to form a better crude and reduce its viscosity;

b. hydrogenating under hydroconverting conditions of 650 degrees Fahrenheit (°F)–1000° F.; and 500–3000 pounds per square inch guage (psig) only a first portion of a crude oil stream less than the total crude oil stream to produce a light oil that has a lowered viscosity;

c. admixing said light oil with the remainder of the crude oil stream not hydrogenated to produce a flowable crude; and d. transporting the flowable crude to a refinery including a substep of flowing the crude through a pipeline.

2. The method of claim 1 wherein said hydrogen is produced by way of reacting methane in the natural gas stream with steam in order to produce hydrogen.

3. The method of claim 2 wherein said methane is reacted with said steam at about 800–1000 Fahrenheit degrees in the presence of a catalyst containing nickel and alumina ($Al_2O_3$).

4. The method of claim 2 wherein additional hydrogen is produced by the reaction of carbon monoxide and water at at least 500 degrees Fahrenheit with an iron oxide-chromium oxide catalyst.

5. The method of claim 1 wherein a second portion of a hydrogenated less viscous crude is recycled as a hydrogen donor for assisting to upgrade said first portion of said heavy crude.

6. The method of claim 1 wherein said first portion is about half of said heavy crude.

7. The method of claim 1 wherein some hydrogenated product from a separator is recycled to a reactor to increase conversion.

8. The method of claim 1 wherein a molybdenum-containing catalyst is employed in the hydroconversion of crude of step b. of claim 1.

* * * * *